US005163531A

United States Patent [19]

Whiting

[11] Patent Number: 5,163,531

[45] Date of Patent: Nov. 17, 1992

[54] PIVOTAL LADDER

[75] Inventor: Lauren C. Whiting, Corfu, N.Y.

[73] Assignee: Whiting Roll-Up Door Mfg. Corp., Akron, N.Y.

[21] Appl. No.: 720,809

[22] PCT Filed: Feb. 26, 1990

[86] PCT No.: PCT/US90/01070

§ 371 Date: Jul. 23, 1991

§ 102(e) Date: Jul. 23, 1991

[87] PCT Pub. No.: WO91/10037

PCT Pub. Date: Jul. 11, 1991

[51] Int. Cl.[5] ..... E06C 5/04

[52] U.S. Cl. ..... 182/89; 182/97; 182/127

[58] Field of Search ..... 182/127, 89, 91, 97, 182/86

[56] References Cited

U.S. PATENT DOCUMENTS

| | | | |
|---|---|---|---|
| 634,385 | 10/1899 | Wolfe | 182/89 |
| 750,893 | 2/1904 | Riggs | 182/89 |
| 4,355,701 | 10/1982 | Nicholson | 182/97 |

*Primary Examiner*—Alvin C. Chin-Shue

*Attorney, Agent, or Firm*—Sommer, Oliverio & Sommer

[57] ABSTRACT

A ladder assembly is adapted to be mounted on a suitable support, such as a truck or trailer. The ladder assembly includes a ladder mounted on the distal end of a shaft. The shaft is slidably received in a cylinder. A pair of spaced abutment stops are provided on the support, and provide a recess to receive a portion of the ladder when the ladder is in its upright position. A spring urges the shaft and ladder to move toward the support along the axis (x—x) of the cylinder. The ladder is adapted to be moved between an upright position, at which a portion of the ladder is received in the recess between the abutment stops, and an out-of-the-way horizontal position.

23 Claims, 3 Drawing Sheets

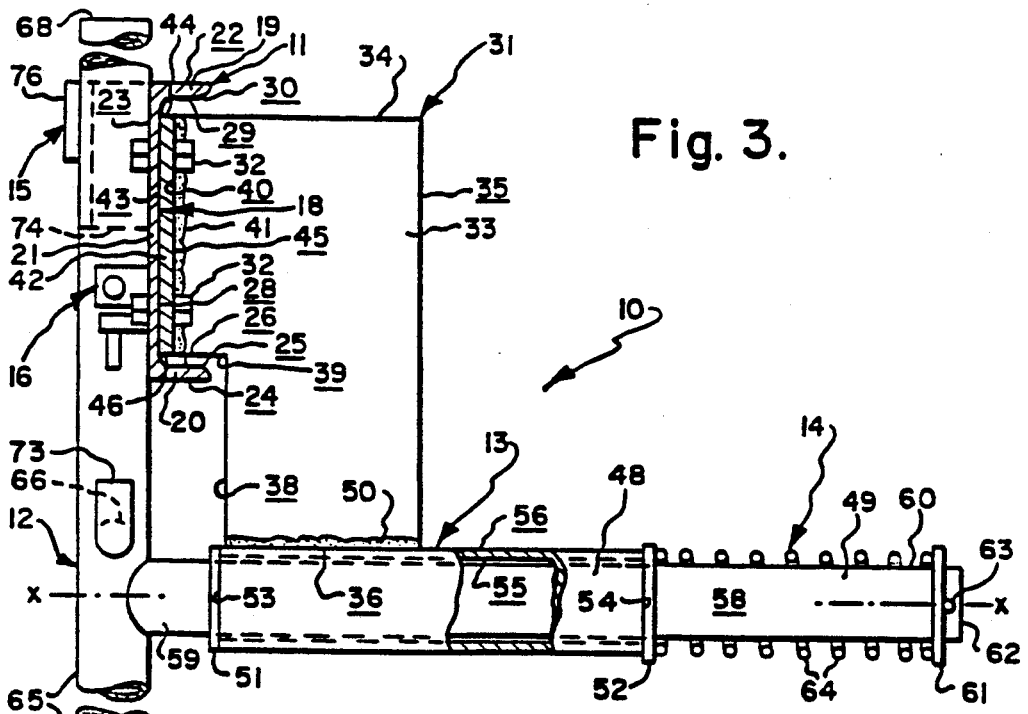
Fig. 3.
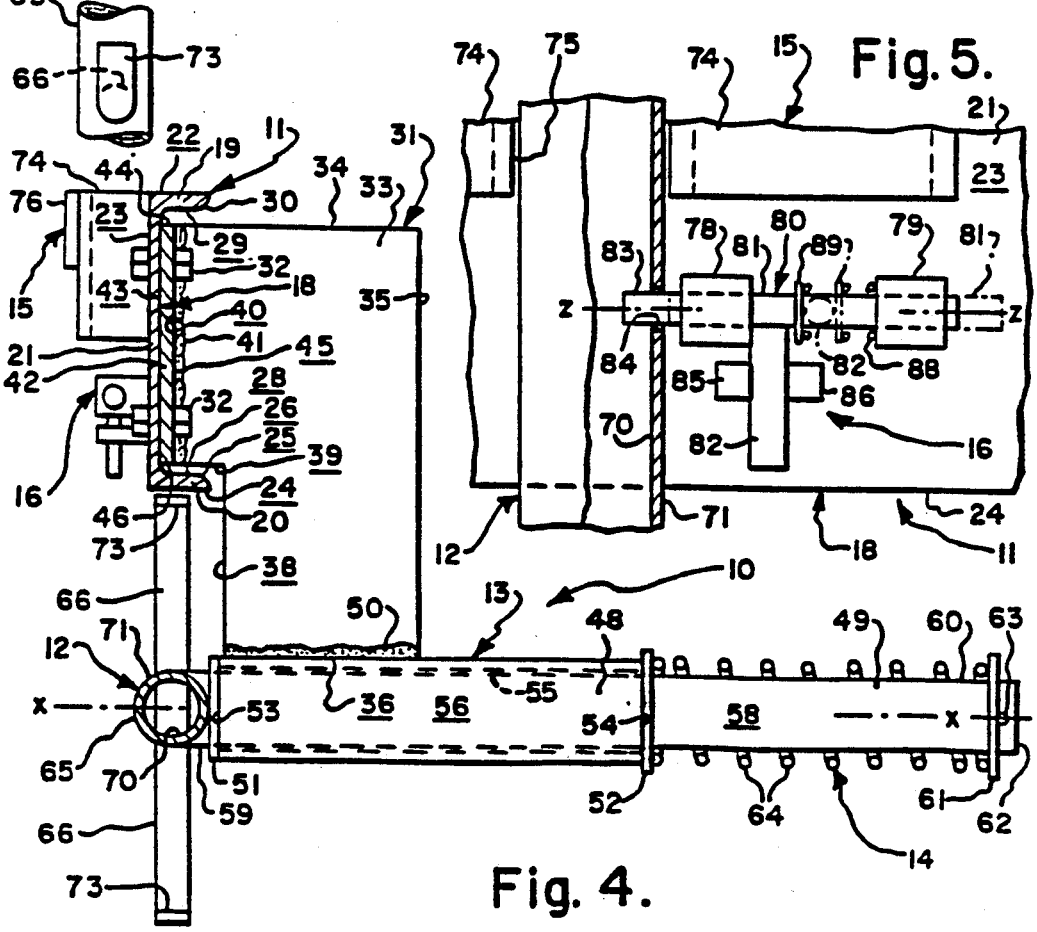
Fig. 5.
Fig. 4.

PIVOTAL LADDER

TECHNICAL FIELD

The present invention relates generally to the field of ladders, and, more particularly, to an improved ladder which is particularly adapted for use on trucks, trailers and the like, and which is adapted to be selectively rotated between an operative upright position and an out-of-the-way horizontal stored position.

BACKGROUND ART

In flatbed trucks and trailers, the driver may have to climb up on to the cargo bed to install chains, check or cover the load, and for other reasons. In many trucks and trailers, the cargo-carrying bed is about 54 inches [137.16 cm] above the ground or road.

When he has to climb up onto a flat-bed trailer, the driver will commonly climb up from the tractor. However, his access to the trailer is often restrained by the so-called "headache bumper" commonly found on the front of trailers, and which functions to prevent an unsecured load from moving inertially forwardly to strike the cab. In such event, the driver must swing himself around this obstruction. Frequently, the tractor is detached from the trailer. The driver will then climb up on a wheel, or will use the rear bumper, sometimes called a "Syracuse bumper". All of these techniques are in common use.

While climbing up on the cargo bed is cumbersome and awkward, climbing down is even more so. In many cases, the driver will simply jump down. This practice has been the source of sprained ankles, bruises, and broken bones.

Accordingly, there is believed to be a clear need for a simplified ladder structure to allow a driver to easily climb up on, and down from, the bed or cargo compartment of a truck or trailer.

DISCLOSURE OF THE INVENTION

The present invention broadly provides an improved ladder assembly, and method of operating same, which is adapted to be mounted on a suitable support, such as a truck, trailer or the like, and which is adapted to permit a person to easily climb up on, and down from, an elevated platform.

In one aspect, the invention provides an improved ladder assembly (e.g., 10) which is adapted to be mounted on a suitable support (e.g., 11), such as a truck or trailer. The support has a first surface (e.g., 23) and a second surface (e.g., 24). The improved ladder assembly broadly includes: a ladder (e.g., 12); pivot means (e.g., 13) acting between the ladder and the support and providing an axis (e.g., x—x) about which the ladder may rotate relative to the support; biasing means (e.g., 14) for urging the ladder to move in one direction along the axis, the ladder being adapted to be selectively moved between an upright position (e.g., as shown in FIGS. 1 and 3) in which one portion of the ladder is arranged to engage the support first surface, and a stored position (e.g., as shown in FIGS. 2 and 4) in which another portion of the ladder is arranged to face the support second surface; and abutment means (e.g., 15) mounted on the support and arranged to prevent the ladder from rotating in a plane perpendicular to the axis when the ladder is in the upright position; whereby the ladder may be selectively rotated between the upright and stored positions by moving (e.g., pulling) the ladder in the opposite direction along the axis, rotating the ladder to the desired angular position, and releasing the ladder to permit the biasing means to move the ladder in one direction along the axis, and then held in the desired position. The improved ladder assembly may further include interlock means arranged to act between the ladder and the support for preventing the ladder from unintentionally moving away from the support along the axis when the ladder is in the upright position.

In another aspect, the invention provides an improved method of moving a ladder between upright and stored positions relative to a support, which method comprises the steps of: mounting a ladder for pivotal movement about an axis; biasing the ladder to move in one direction along the axis; manually moving the ladder in the opposite direction along the axis by overcoming such opposing bias; selectively rotating the ladder about the axis to the desired one of said upright and stored positions; releasing the ladder to allow said ladder to move in the biased direction along said axis into the desired position, and thereafter holding the ladder in the desired position.

Accordingly, the general object of the invention is to provide an improved ladder assembly which is adapted to be mounted on a suitable support, not necessarily limited to a truck or trailer, to enable a person to easily climb up onto, and down from, an elevated platform.

Other specific objects are to provide an improved truck or trailer ladder which is simple in construction, dependable in operation, which does not interfere with the normal operation of the truck or trailer even if the ladder is inadvertently left in its upright position, which allows a person to easily climb up onto, or down from, the bed of the truck or tailer, and which reduces injuries attributable to the past practice of simply jumping from such bed.

Still another object is to provide an improved method of selectively rotating a vehicle-mounted ladder between an operative upright position and a lowered out-of-the way position.

These and other objects and advantages will become apparent from the foregoing and ongoing written specification, the drawings, and the appended claims.

BRIEF DESCRIPTION OF THE DRAWINGS

FIG. 3 is a fragmentary vertical sectional view of the improved ladder assembly shown in FIG. 1, this view being taken generally on line 3—3 of FIG. 1.

FIG. 4 is a fragmentary vertical sectional view of the improved ladder assembly shown in FIG. 2, this view being taken generally on line 4—4 of FIG. 2.

FIG. 5 is a fragmentary side elevation showing the interlock means as engaging the upright ladder to prevent it from moving axially away from the support.

MODE(S) OF CARRYING OUT THE INVENTION

Figure 1:
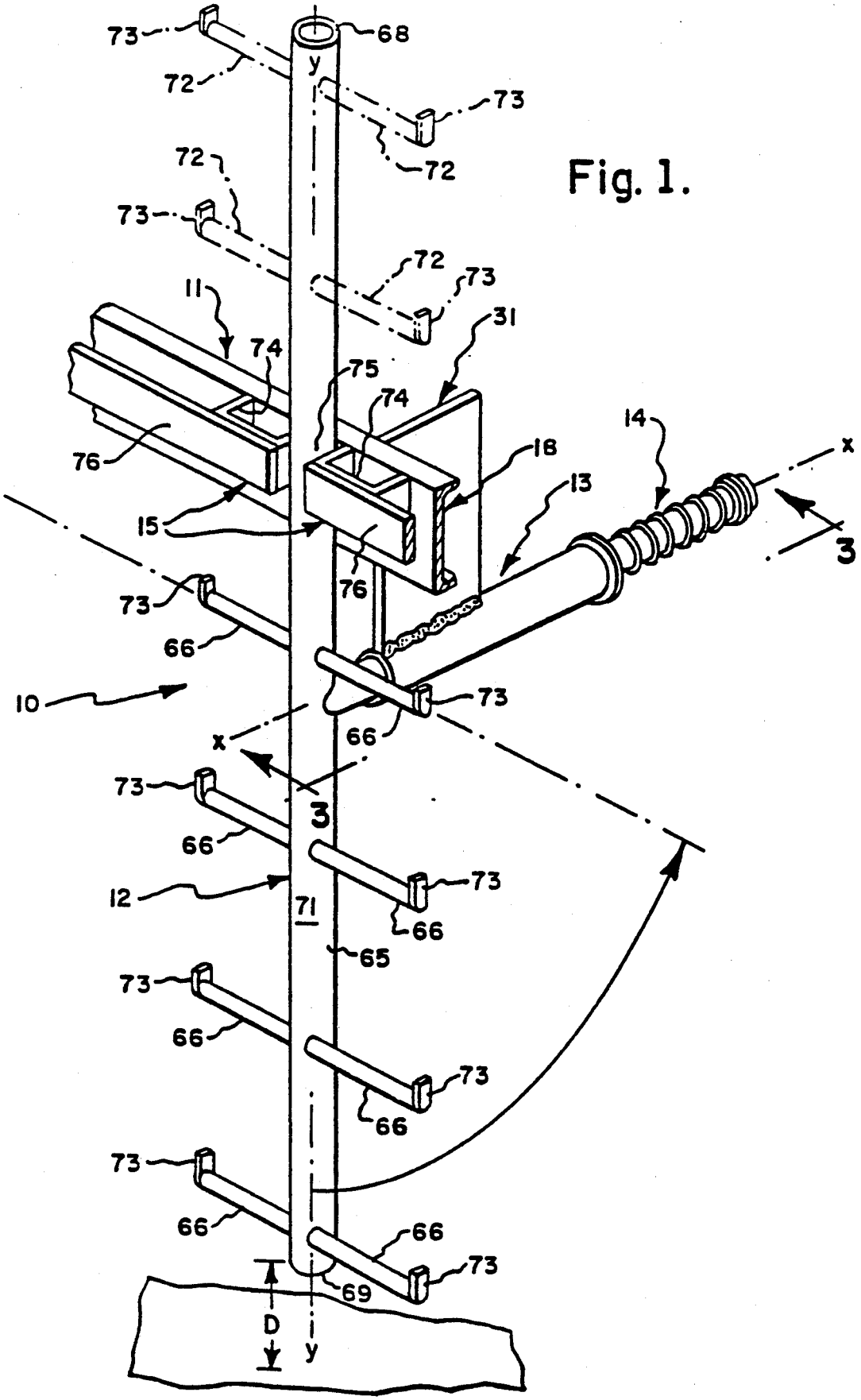
FIG. 1 is a perspective view of the presently-preferred form of the improved ladder assembly mounted on a fragmentary portion of a truck or trailer, and shows the ladder as being in its upright position.

At the outset, it should be clearly understood that like reference numerals are intended to identify the same structural elements, portions or surfaces consistently throughout the several drawing figures, as such elements, portions or surfaces may be further described or explained by the entire written specification of which this detailed description is an integral part. Unless otherwise indicated, the drawings are intended to be read (e.g., arrangement of parts, mounting, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Unless otherwise indicated, the terms "inwardly" and "outwardly" refer to the orientation of a surface relative to its axis of elongation, or axis or rotation, as appropriate.

Figure 2:
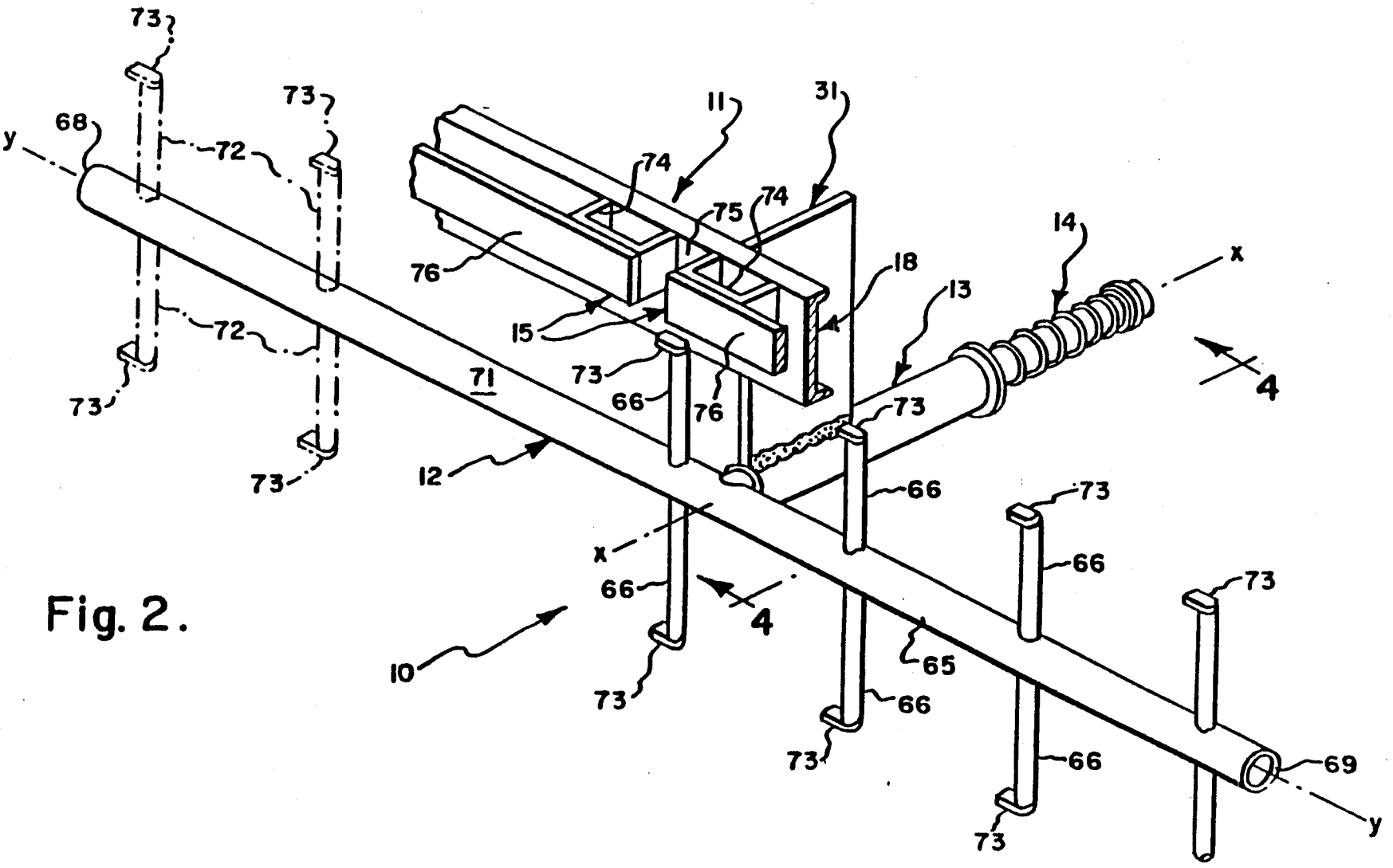
FIG. 2 is a perspective view generally similar to the view of FIG. 1, but shows the ladder as having been rotated 90° in a counter-clockwise direction from the position shown in FIG. 1, and moved axially toward the support, to its inoperative out-of-the-way position.

Referring now to the drawings, and, more particulary, to FIGS. 1 and 2 thereof, this invention broadly provides an improved ladder assembly, of which the presently-preferred embodiment is generally indicated at 10, which is adapted to be mounted on a suitable support, generally indicated at 11. In the accompanying drawings, the support is specifically shown as being a fragmentary portion of the cargo-carrying bed of a truck or trailer (not fully shown). However, it should be clearly understood that the invention is not limited to use with trucks, trailers or other types of vehicle, but possesses general utility and may be used in association with virtually any type of elevated platform.

In any event, the improved ladder assembly 10 is shown as broadly including a ladder 12, pivot means 13 acting between the ladder and the support and providing an axis x—x about which the ladder may be selectively rotated relative to the support in a plane generally perpendicular to the axis, biasing means 14 urging the ladder to move in one direction along the axis, and abutment means 15 mounted on the support and arranged to prevent the ladder from rotating in a plane perpendicular to the axis when the ladder is in its upright position and is engaged with the support. The improved ladder assembly preferably further includes interlock means, generally indicated at 16 (FIG. 5), selectively acting between the ladder and support for preventing the ladder from being unintentionally moved in the one direction along the axis (i.e., against the opposing urging of the biasing means) when the ladder is in its upright position and is engaged with the support.

As best shown in FIGS. 1–4, the support includes, in pertinent part, an elongated inwardly-facing channel-shaped member 18, which extends the length of the truck or trailer (not fully shown) at a side thereof. Member 18 is shown as having upper and lower horizontal flanges 19, 20 extending transversely inwardly (i.e., toward the center of the truck or trailer, and rightwardly in FIGS. 1–4) from an outer (i.e., leftward in FIGS. 1–4) vertical web 21. More particularly, support member 18 has a plurality of longitudinally-extending surfaces. When seen in transverse cross-section (FIGS. 3–4), support member 18 is sequentially bounded by: an upwardly-facing planar horizontal surface 22, a leftwardly-facing planar vertical surface 23 depending from the left margin of surface 22, a downwardly-facing planar horizontal surface 24 extending rightwardly from the lower margin of surface 23, a rightwardly- and upwardly-facing rounded surface 25, an upwardly-facing planar horizontal surface 26 extending leftwardly from the left margin of surface 25, a rightwardly-facing planar vertical surface 28 extending upwardly from the left margin of surface 26, a downwardly-facing planar horizontal surface 29 extending rightwardly from the upper margin of surface 28, and a rightwardly- and downwardly-facing rounded surface 30 continuing therefrom to rejoin the right margin of upper surface 22. Thus, web 21 is generally defined between vertical surfaces 23, 28, upper flange 19 is generally defined between horizontal surfaces 22, 29, and lower flange 20 is generally defined between horizontal surfaces 24, 26. Surfaces 23, 24 constitute first and second surfaces, respectively, of the support member 18.

A generally T-shaped bracket assembly, generally indicated at 31, is adapted to be suitably secured to the inner surface 28 of support member 18, by a plurality of bolt-like fasteners, severally indicated at 32. This bracket assembly includes a transversely-extending vertical plate-like portion 33, which is sequentially bounded by: an upwardly-facing horizontal surface 34, a rightwardly-facing vertical surface 35 extending downwardly from the right margin of surface 34, a downwardly-facing horizontal surface 36 extending leftwardly from the lower margin of surface 35, a leftwardly-facing vertical surface 38 extending upwardly from the left margin of surface 36, a downwardly-facing horizontal surface 39 extending leftwardly from the upper margin of surface 38, and a leftwardly-facing vertical surface 40 continuing upwardly therefrom to join the left margin of upper surface 34. Plate portion surface 40 is shown as being secured, as by weld 41, to an intermediate portion of a longitudinally-extending plate-like portion 42, having its leftwardly-facing planar vertical surface 43 engaging support member web surface 28 in area contact. Portion 42 is further shown as including, in transverse cross-section: a horizontal upper surface 44 arranged in the same plane as bracket upper surface 34, a rightwardly-facing planar vertical surface 45 engaged by bracket surface 40, and a horizontal lower surface 46 which is arranged in the plane of bracket surface 39. Thus, the bracket assembly 31 is somewhat T-shaped when seen in top plan, with plate portion 42 forming the cross-bar, and plate portion 33 forming the cantilevered leg. Bracket portion 42 and support member web 21 are provided with a plurality of aligned holes to accommodate passage of a like plurality of fasteners 32 by which the bracket assembly 31 may be removably secured to the support member.

As best shown in FIGS. 3 and 4, pivot means 13 includes a horizontally-elongated open-ended cylindrical tube 48, and a cylindrical tubular shaft 49 slidably received within tube 48 for both axial and rotative movement relative thereto. Tube 48 is suitably secured to bracket lower surface 36 by means of one or more weldments 50 on either side of plate portion 33. Tube 48 is shown as having washer-like plates 51, 52 positioned to bear against its annular vertical left and right end faces 53, 54, respectively. Outer plate 51 may be suitably secured to the left end face of the tube. Inner plate 52, however, may be either secured to the tube, or may simply loosely encircle shaft 49, as desired. Tube 48 has inwardly- and outwardly-facing cylindrical surfaces 55, 56, respectively, which are severally generated about horizontal axis x—x.

In the preferred embodiment, shaft 49 is a horizontally-elongated cylindrical tube slidably arranged within outer cylindrical tube 48. The outwardly-facing cylindrical surface 58 of the shaft is therefore arranged to face the inwardly-facing cylindrical surface 55 of the cylinder. Thus, shaft 49 is also elongated along axis x—x. The shaft is longer than the cylinder such that a left marginal end portion 59 extends outwardly from the cylinder beyond left plate 51, and a right marginal end portion 60 thereof extends outwardly beyond the cylinder beyond right plate 52. Another annular plate 61, which also somewhat resembles a flat-washer, loosely surrounds shaft 49 adjacent its annular vertical right end face 62, and is precluded from moving further rightwardly relative to the shaft by means of a pin 63 penetrating a diametrical hole (not shown) provided through the right marginal end portion of the shaft. The left end of shaft 49 is saddle-shaped, and is arranged to engage the post of the ladder, as described infra. Thus, the shaft is slidably received within the outer cylinder for both axial and rotative movement relative thereto. The shaft may be either solid or tubular, as desired.

In the preferred embodiment, biasing means 14 is simply a coil spring 64, which encircles the right marginal end portion 60 of the shaft, and which acts between cylinder plate 52 and shaft plate 61. The spring 64 is compressed, and therefore continuously urges the shaft to move in one direction (i.e., rightwardly as seen in FIGS. 3 and 4) along axis x—x relative to the cylinder. If cylinder plate 52 is not secured to the cylinder, spring 64 will hold these two members in tight abutting engagement.

Referring now to FIGS. 1-4 collectively, ladder 10 is shown as having an elongated post 65 and a plurality of rungs, severally indicated at 66, extending normally (i.e., perpendicularly) outwardly from the post. Post 65 is shown as being a thin-walled cylindrical tube, is elongated along post axis y—y, and has annular distal end faces 68, 69, respectively. The saddle-shaped outer or left end of shaft 49 embraces an intermediate portion of post 65, preferably proximate the mid-point of the post. As best shown in FIGS. 4 and 5, the post has inwardly- and outwardly-facing cylindrical surfaces 70, 71, respectively. The post is further provided with a plurality of longitudinally-spaced diametrical throughholes (not shown) to accommodate passage of tubular members which form rungs 66. These rungs may be secured to the post by suitable weldments (not shown). In FIG. 1, four of such rungs are provided through the post at longitudinally-spaced locations therealong between support member 18 and post lower end 69. If desired, additional rungs, shown in phantom and severally indicated at 72, could be provided between the support member and the upper end 68 of the post. These upper rungs, if provided, are intended as graspable handles to assist a person in ascending and descending the ladder when in the upright position. However, these upper rungs or handles 72 are optional, and may be entirely omitted if desired. If omitted, the portion of post 65 which extends above the flat-bed (i.e., the portion between member 18 and upper end 68 when the post is in its upright position) is available to be grasped as the driver ascends and descends the ladder. In the illustrated form, however, each of rungs 66 and handles 72 is provided with a plate-like end piece, severally indicated at 73, to prevent a person's hand or foot from slipping off the end of the associated rung or handle. Ladder 12 is adapted to be selectively rotated between an upright or operative position, as shown in FIG. 1, and a lowered substantially horizontal out-of-the-way position, as shown in FIG. 2, as described infra. When in its upright position, however, the post lower end 69 is preferably spaced above the ground or road by a vertical dimension D, as shown in FIG. 1.

In the preferred embodiment, the abutment means 15 includes a pair of longitudinally-spaced U-shaped brackets or stake pockets, severally indicated at 74, suitably secured to web outer surface 23. These stake pockets are intended to receive stakes (not shown), and provide a space 75 therebetween which is adapted to receive a portion of the post when the ladder is in its upright position. These stake pockets function to prevent the upright ladder from rotating about axis x—x when a portion of the post is arranged between the two stake pockets and when the post engages web outer surface 23. A longitudinally-elongated rectangular bar, severally indicated at 76, is suitably secured, as by weldments, to the outer surfaces of the stake pockets spaced along the support in parallel spaced relation to web outer surface 23. This plate is interrupted in the vicinity of recess 75 defined between the pockets and is generally available to receive cables and chains by which the load may be secured to the cargo body, or cords or the like by which a cover or tarpaulin may be tied down.

Referring now to FIG. 5, in the preferred embodiment, the interlock means 16 includes a pari of horizontally-spaced aligned collars 78, 79, secured to support web outer surface 23, and a latch 80 slidably received in such collars. This latch is shown as including a horizontally-elongated slide bolt 81, and a handle portion 82. As best shown in FIG. 5, the left marginal end portion 83 of bolt 81 is adapted to be received in a hole 84 provided in the post, when the post is in its upright position. A pair of horizontally-spaced lugs, 85, 86 extend outwardly from web outer surface 23 to embrace handle portion 82. If desired, lug 85 might be omitted. Also, if desired, a spring 88 may be arranged to act between the annular vertical left face of right collar 79 and and annular vertical flange 89 fixed to, and extending radially outwardly from, an intermediate portion of bolt 81. The function of this spring, if provided, is simply to bias the slide-bolt to move leftwardly into engagement with the post. Thus, an operator may simply grasp handle portion 82, may rotate the latch bolt about the axis z—z of bolt portion 81, may move the entire latch bolt either leftwardly or rightwardly, as desired, and then may thereafter rotate the latch assembly to a position at which the left marginal end portion of the latch bolt will be locked in its extended or retracted position, as desired, relative to the post. As noted above, the function of the interlock means is to prevent the ladder post from unintentionally moving away from the support along axis x—x, when the ladder is in the upright position.

OPERATION

To move the ladder from its upright operative position shown in FIG. 1 to this horizontal stored position shown in FIG. 2, the operator need only grasp the ladder, preferably along the post, and pull it outwardly (i.e., leftwardly as seen in FIG. 3) against the opposing bias exerted by spring 64. Once the post has been removed from the space 75 between the abutment means, the opertor may then rotate the ladder assembly about pivotal axis x—x. In the illustrated embodiment, the ladder assembly may be rotated in either the clockwise or counter-clockwise direction. FIG. 2, however, shows the ladder assembly as having been rotated 90° in a counter-clockwise direction from the position shown in FIG. 1. When in such horizontal position, the operator may simply lessen his pull on the ladder assembly, to allow spring 64 to expand, and to move the ladder rightwardly relative to the cylinder. The effect of this is to move the horizontally-disposed ladder beneath suppor member 18, as shown in FIG. 4. Ultimately, a post 65 will engage cylinder plate 51 to limit further relative movement between the shaft and cylinder, as shown in FIG. 4. When in the horizontal stored position, as shown in FIG. 4, the end pieces 73 attached to the various rungs and handles will be arranged in closely-spaced facing relation to support member lower surface 24. Thus, when the ladder is in its horizontal stored position, relative rotation between the ladder and support about pivot axis x—x is limited by the fact that the end piece 73 of the rung farthest from axis x—x will engage support member lower surface 24. Thus, when in the horizontal position, the stored ladder is restrained from substantial pivotal movement relative to the support. The extent of such permissible movement is defined by the spacing between the end piece 73 of the most-remote rung and support member lower surface 24.

To move the ladder from it stored position to its upright position, the foregoing sequence of steps is simply reversed. The operator simply grasps the ladder, preferably by the post, and pulls it outwardly against the opposing bias of spring 64. When pulled outwardly beyond bar 76, the ladder may be rotated in a clockwise direction through an angle of 90° so that the post is vertically aligned. Thereafter, the operator controllably releases the force he exerts on the ladder, and aligns the post with the recess 75 between the abutment means. As the operator reduces the force exerted on the post, spring 64 expands, and pulls the post into space 75. Such movement will continue until post 65 engages support member outer surface 23. Thereafter, the ladder is restrained from rotational movement about axis x—x. The ladder may be held in this operative upright position by means of interlock means 16, which precludes the ladder from unintentionally moving outwardly along axis x—x. In this opertive position, a portion of the post extends above and below the load-carrying platform.

Therefore, the present invention provides an improved pivotal ladder assembly which is adapted to be mounted on a suitable support, and an improved method of selectively moving the ladder assembly an upright positoin and a stored position.

MODIFICATIONS

The present invention contemplates that many changes and modifications may be made. For example, while ladder 12 is shown as being a scaling or fireman's ladder, other types of ladders might be readily substituted therefor. The pivot means may engage either a support, a rung or a handle of the ladder. While it is presently preferred to have the pivot means engage the ladder in the vicinity of the midpoint of the ladder's longitudinal extent, this may be changed or modified as desired. For example, if the ladder were being used to afford access to a rear cargo compartment, it might be preferable to have the pivot means engage the ladder near one end thereof. In this alternative embodiment, a portion of the post need not extend upwardly beyond the floor of the cargo compartment, as handles may be placed at appropriate locations on the cargo body.

The improved ladder assembly is not limited to use with trucks, trailers or the like, but may be operatively associated with virtually any type of elevated platform. In this regard, the bracket assembly 31 may be readily changed to provide a suitable means or mechanism by which the pivot means is held in a desired position relative to the support. The abutment means need not be formed by defining a space 75 between two stake pockets. Alternatively, such abutment means could be a pair of angle-shaped members, or simply a pair or lugs extending outwardly from the support. The interlock means, while preferable and desired, is optional. Indeed, other types of interlock mechanisms may be substituted therefor. For example, it might be possible to provide a gate (not shown) at the mouth of the entrance to recess 75 to prevent the post from unintentionally moving outwardly along axis x—x and leaving the recess. As noted above, the shaft may be either solid or cylindrical, as desired. In addition to this, various bearings could be provided between the shaft and cylinder, if desired.

The rungs may be longitudinally staggered on either side of the post, much in the manner seen on telephone poles, or may extend through the post (as shown), as desired. The number, size and spacing of these rungs is regarded as a matter of design choice. Handles 72 may be provided, or omitted, as desired. While these are convenient, an operator may attempt to climb further upwardly on the ladder assembly beyond the surface of the bed. Thus, handle 72 could be simply omitted, if desired. In this alternative arrangement, the operator can clearly grasp the upper marginal end portion of the post as he ascends or descends the ladder.

Another feature of the invention is that the ladder does not extend outwardly beyond the side of the truck or trailer when in either its upright or stored positions. Indeed, the ladder is preferably configured so that even in the upright position, the lower marginal end portion of the ladder is spaced above the ground or road by a dimension D. Thus, if the ladder is unintentionally left in its upright position, the vehicle may be operated without damage to the improved ladder assembly.

Therefore, while the presently-preferred form of the improved ladder assembly has been shown and described, and several modifications and changes thereof discussed, persons skilled in this art will readily appreciate that various additional changes and modifications may be made without departing from the spirit of the invention, as defined and differentiated by the following claims.

I claim:

1. A ladder assembly mounted on a support, said support having a first surface and a second surface, said ladder assembly comprising:

a ladder;

pivot means acting between said ladder and said support and providing an axis about which said ladder may be rotated relative to said support;

biasing means urging said ladder to move in one direction along said axis, said ladder being adapted to be moved between an upright position in which one portion of said ladder is arranged to engaged said support first surface and a stored position in which another portion of said ladder is arranged to face said support second surface;

abutment means mounted on said support and arranged to prevent said ladder from rotating in a plane perpendicular to said axis when said ladder is in said upright position; and interlock means acting between said ladder and said support for preventing said ladder from being unintentionally moved in said one direction along said axis when said ladder is in said upright position;

whereby said ladder may be selectively rotated between said upright and stored positions by moving said ladder along said axis in the opposite direction against the opposing bias of said biasing means, rotating said ladder to the desired one of said upright and stored positions, and then releasing said ladder to permit said biasing means to move said ladder in said one direction along said axis.

2. A ladder assembly as set forth in claim 1 wherein said support is a vehicle.

3. A ladder assembly as set forth in claim 2 wherein the lower end of said ladder does not engage the ground when said ladder is in said upright position.

4. A ladder assembly as set forth in claim 1 wherein said support first surface is substantially vertical.

5. A ladder assembly as set forth in claim 1 wherein said support second surface is substantially horizontal.

6. A ladder assembly as set forth in claim 5 wherein said support second surface faces downwardly.

7. A ladder assembly as set forth in claim 1 wherein said abutment means provides a recess adapted to receive a portion of said ladder when said ladder is in said upright position.

8. A ladder assembly as set forth in claim 1 wherein said interlock means includes a pin slidably mounted on said support and adapted to be moved toward and away from said ladder when said ladder is in said upright position, and wherein said ladder is provided with a recess to receive said pin.

9. A ladder assembly as set forth in claim 1 wherein said ladder is a scaling ladder having a rung extending normally away from a post.

10. A ladder assembly as set forth in claim 9 wherein said support first surface engages said post when said ladder is in said upright position.

11. A ladder assembly as set forth in claim 10 wherein said pivot means engages said post at a position intermediate the longitudinal extent of said post.

12. A ladder assembly as set forth in claim 11 wherein said pivot means engages said post proximate the midpoint of the longitudinal extent of said post.

13. A ladder assembly as set forth in claim 9 wherein said ladder one portion is said post and said ladder other portion is a the distal end of said rung.

14. A ladder assembly as set forth in claim 1 wherein the position of said ladder relative to said support second surface limits pivotal movement of said ladder about said axis relative to said support when said ladder is in said stored position.

15. A ladder assembly as set forth in claim 1 wherein said pivot means provides the sole means for holding said ladder to said support when said ladder is in said stored position.

16. A ladder assembly as set forth in claim 1 wherein the axis of elongation of said ladder is in different planes when said ladder is in said upright and stored positions.

17. A ladder assembly as set forth in claim 1 wherein said pivot means engages said ladder at an intermediate portion of the longitudinal extent of said ladder.

18. A ladder assembly as set forth in claim 1 wherein said pivot means includes a cylindrical tube, and a shaft received within said tube for axial and rotational movement relative thereto.

19. A ladder assembly as set forth in claim 18 wherein said biasing means includes a spring acting between said shaft and tube for urging said shaft to move in said one direction relative to said tube along said axis.

20. A ladder assembly as set forth in claim 18, and further comprising:

a bracket arranged between said support and tube for holding said tube in a desired position relative to said support.

21. The method of moving a ladder between upright and stored positions relative to a support, comprising the steps of:

mounting a ladder for pivotal movement about an axis;

biasing said ladder to move in one direction along said axis;

manually moving said ladder in the opposite direction along said axis by overcoming the opposing bias on said ladder;

selectively rotating said ladder about said axis to the desired one of said upright and stored positions;

releasing said ladder to allow said ladder to move in said one direction along said axis; and locking said ladder to said support to prevent said ladder from being unintentionally moved in said one direction along said axis when said ladder is in said upright position.

22. A ladder assembly mounted on a support, said support having a first surface and a second surface, said ladder assembly comprising:

a ladder;

pivot means acting between said ladder and said support, said pivot means engaging said ladder at an intermediate portion of its longitudinal extent and providing an axis about which said ladder may be rotated relative to said support;

biasing means urging said ladder to move in one direction along said axis, said ladder being adapted to be moved between an upright position in which one portion of said ladder is arranged to engage said support first surface and a stored position in which another portion of said ladder is arranged to face said support second surface; and abutment means mounted on said support and arranged to prevent said ladder from rotating in a plane perpendicular to said axis when said ladder is in said upright position;

whereby said ladder may be selectively rotated between said upright and stored positions by moving said ladder along said axis in the opposite direction against the opposing bias of said biasing means, rotating said ladder to the desired one of said upright and stored positions, and then releasing said ladder to permit said biasing means to move said ladder in said one direction along said axis.

23. A ladder assembly mounted on a support, said support having a first surface and a second surface, said ladder assembly comprising:

a sealing ladder having an elongated post and having a rung extending away from said post;

pivot means acting between said ladder and said support, said pivot means engaging said post at an intermediate portion of its longitudinal extent and providing an axis about which said ladder may be rotated relative to said support;

biasing means urging said ladder to move in one direction along said axis, said ladder being adapted to be moved between an upright position in which one portion of said ladder is arranged to engage said support first surface and a stored position in which another portion of said post is arranged to face said support second surface; and abutment means mounted on said support and arranged to prevent said ladder from rotating in a plane perpendicular to said axis when said ladder is in said upright position;

whereby said ladder may be selectively rotated between said upright and stored positions by moving said ladder along said axis in the opposite direction against the opposing bias of said biasing means, rotating said ladder to the desired one of said upright and stored positions, and then releasing said ladder to permit said biasing means to move said ladder in said one direction along said axis.

* * * * *